US010517362B2

(12) United States Patent
Kim

(10) Patent No.: US 10,517,362 B2
(45) Date of Patent: Dec. 31, 2019

(54) VERSATILE BAG

(71) Applicant: Hyun Jeong Kim, Goyang-si (KR)

(72) Inventor: Hyun Jeong Kim, Goyang-si (KR)

( * ) Notice: Subject to any disclaimer, the term of this patent is extended or adjusted under 35 U.S.C. 154(b) by 0 days.

(21) Appl. No.: 15/565,742

(22) PCT Filed: Apr. 11, 2016

(86) PCT No.: PCT/KR2016/003802
§ 371 (c)(1),
(2) Date: Oct. 11, 2017

(87) PCT Pub. No.: WO2016/167522
PCT Pub. Date: Oct. 20, 2016

(65) Prior Publication Data

US 2018/0078013 A1 Mar. 22, 2018

(30) Foreign Application Priority Data

Apr. 13, 2015 (KR) ..... 10-2015-0052055

(51) Int. Cl.

| | |
|---|---|
| ***A45C 3/06*** | (2006.01) |
| ***A45C 3/00*** | (2006.01) |
| ***A45C 3/08*** | (2006.01) |
| ***A45C 13/18*** | (2006.01) |
| ***A45C 13/30*** | (2006.01) |
| ***A45C 1/02*** | (2006.01) |

(Continued)

(52) U.S. Cl.
CPC ..... *A45C 3/06* (2013.01); *A45C 1/02* (2013.01); *A45C 3/00* (2013.01); *A45C 3/08* (2013.01); *A45C 13/02* (2013.01); *A45C 13/08* (2013.01); *A45C 13/103* (2013.01); *A45C 13/18* (2013.01); *A45C 13/26* (2013.01); *A45C 13/30* (2013.01); *A45C 13/023* (2013.01)

(58) Field of Classification Search
CPC ... A45C 13/103; A45C 2013/026; A45C 1/02; A45C 3/06
USPC ..... 150/103, 104, 105, 113; 383/2; 190/104.105
See application file for complete search history.

(56) References Cited

U.S. PATENT DOCUMENTS 1,597,339 A * 8/1926 Berkowitz ..... A45C 3/06 150/103
3,292,747 A * 12/1966 Dawson ..... A45C 7/0063 190/103

(Continued)

FOREIGN PATENT DOCUMENTS

KR 20-1991-0006851 Y1 9/1991
KR 20-0213760 Y1 2/2001

(Continued)

OTHER PUBLICATIONS

International Search Report for PCT/KR2016/003802.

*Primary Examiner* — Sue A Weaver
(74) *Attorney, Agent, or Firm* — Schmeiser, Olsen & Watts, LLP

(57) ABSTRACT

Provided is a versatile bag, including: a containing portion, one side of which is open, thereby forming a main containing chamber for storing belongings; and a deformable portion, which changes the shape thereof, thereby covering the main containing chamber or covering the outside of the containing portion. Embodiments of the present invention can implement a bag that has various shapes and uses.

8 Claims, 15 Drawing Sheets

(51) Int. Cl.

| | |
|---|---|
| ***A45C 13/02*** | (2006.01) |
| ***A45C 13/08*** | (2006.01) |
| ***A45C 13/26*** | (2006.01) |
| ***A45C 13/10*** | (2006.01) |

(56) References Cited

U.S. PATENT DOCUMENTS 4,037,633 A * 7/1977 Gordon ..... A45C 13/26 150/110
4,182,391 A * 1/1980 Kjose ..... A63B 55/40 224/581
5,270,251 A * 12/1993 Cohen ..... H01L 23/5254 257/E23.148
5,361,951 A * 11/1994 Chehebar ..... A45F 3/04 150/103
5,535,797 A 7/1996 Martindale
5,881,788 A * 3/1999 Hersh ..... A45C 3/06 150/116
6,161,665 A * 12/2000 Hoover ..... A45C 3/00 190/103
8,267,130 B1 * 9/2012 Sinnett ..... A45C 3/001 150/112
8,820,596 B1 * 9/2014 Bergquist ..... A45F 4/02 224/153
9,144,277 B2 * 9/2015 Donaldson ..... A45C 7/0059
2001/0027834 A1 * 10/2001 Southwick ..... A45C 3/00 150/108
2005/0263226 A1 * 12/2005 Smithers ..... A45C 1/02 150/113
2008/0237068 A1 * 10/2008 Melamed ..... A45C 1/024 206/5
2009/0034884 A1 * 2/2009 Chih ..... A45C 3/06 383/25
2012/0241482 A1 * 9/2012 Mabika ..... A45C 3/06 224/148.4

FOREIGN PATENT DOCUMENTS

KR 10-0879276 B1 1/2009
KR 20-0451267 Y1 12/2010
KR 1020110090282 8/2011

* cited by examiner

VERSATILE BAG

CROSS-REFERENCE TO RELATED APPLICATIONS

This application claims priority to PCT Application No. PCT/KR2016/003802 having a filing date of Apr. 11, 2016, based off of Korean Patent Application No. 10-2015-0052055, having a filing date of Apr. 13, 2015, the entire contents of all which are hereby incorporated by reference.

FIELD OF TECHNOLOGY

The following relates to a versatile bag, and more particularly, to a versatile bag capable of easily accommodating personal effects with improved portability.

BACKGROUND

Generally, a bag provides a space for storing personal effects of a user. Also, the bag provides mobility for moving the stored personal effects to a destination. Meanwhile, women who are going out store various personal effects such as simple basic cosmetic products, tissue paper, a wallet, and the like in a bag.

So far, when women want to change bags for going out, there is a problem of moving personal effects stored in an existing bag into a new bag one by one. Accordingly, it is necessary to fix the problem.

SUMMARY

An aspect relates to a versatile bag which performs the function of a bag and is usable as necessary as a storage bag in various other bags without moving personal effects.

A versatile bag according to embodiments of the present invention includes a storage including a main storage compartment which has one side open and stores personal effects and a deformable portion which has a deformable shape to cover the main storage compartment or an outside of the storage.

The storage may include a storage body with an outside to which the deformable portion is coupled, a storage divider which is coupled to an inside of the storage body to divide the storage body and includes a divided storage compartment, and a compartment opener which is formed at the storage divider and opens and closes the divided storage compartment.

The storage may further include an auxiliary storage which is formed inside the storage body and includes an auxiliary storage compartment and an auxiliary opener which is formed at the auxiliary storage and opens and closes the auxiliary storage compartment.

The storage may further include an additional storage which is coupled to the inside of the storage body and forms an additional storage compartment between the additional storage and the storage body, a storage extender which is coupled to the storage body to be built in the additional storage compartment or withdrawn from the additional storage compartment and includes a plurality of storing portions to store items, and a storage fastener which attaches and detaches the additional storage to and from the storage body.

The storage may further include a cover protector which is formed at the storage extender and protects the items.

The storage may further include a storage holder which is formed at the storage body where a ring is attached and detached.

The storage may further include a storage string formed at the storage body, a string holder formed at the storage string, and a storage wallet attachable to and detachable from the string holder.

The deformable portion may include a deformable cover coupled to the outside of the storage and partially incised and a deformable operator which is formed at the deformable cover and attaches and detaches the partially incised deformable cover.

The deformable portion may further include a deformation identifier which is formed at the deformable cover and shows a color.

The versatile bag may further include a portability portion coupled to any one of the storage and the deformable portion to allow portability of the storage.

The portability portion may be a strap which is coupled to any one of the storage and the deformable portion, is adjustable in length, and is worn on a human body.

The portability portion may be handles which are coupled to any one of the storage and the deformable portion and are grippable.

The handles may be coupled to an inside of any one of the storage and the deformable portion and may be insertable into any one of the storage and the deformable portion.

A versatile bag according to embodiments of the present invention may be used as an inner bag or an outer bag depending on a change in shape thereof.

A versatile bag according to embodiments of the present invention may divide a main storage compartment of a storage body by using a storage divider.

A versatile bag according to embodiments of the present invention may store personal effects by using an auxiliary storage compartment formed in an auxiliary storage.

A versatile bag according to embodiments of the present invention may be used while a storage extender stored in an additional storage portion is withdrawn from a storage as necessary.

A versatile bag according to embodiments of the present invention may easily store a car key and may prevent a storage wallet from being lost or stolen.

A versatile bag according to embodiments of the present invention may allow a storage to be used alone by using a portability portion.

BRIEF DESCRIPTION

Some of the embodiments will be described in detail, with reference to the following figures, wherein like designations denote like members, wherein.

DETAILED DESCRIPTION

Figure 1:
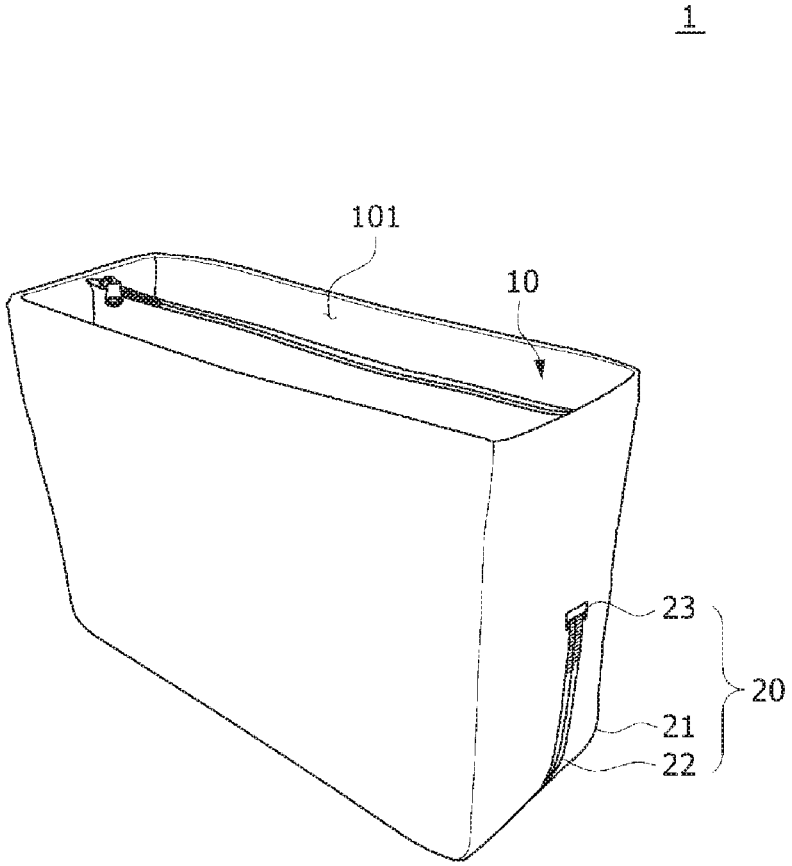
FIG. 1 is a view schematically illustrating a state in which a versatile bag according to one embodiment of the present invention is deformed into an inner bag shape.

FIG. 1 is a schematic diagram illustrating a state in which a versatile bag according to one embodiment of the present invention is deformed into an inner bag shape. Referring to FIG. 1, a versatile bag 1 according to one embodiment of the present invention includes a storage 10 and a deformable portion 20.

The storage 10 includes one side which is openable. The storage 10 includes a main storage compartment 101 for storing personal effects. The deformable portion 20 is deformed in shape to cover the main storage compartment 101 or an outside of the storage 10. For example, the deformable portion 20 is coupled to an outer surface of the storage 10 and may be unfolded downward to cover the storage 10 or be unfolded upward to cover main storage compartment 101.

Figure 2:
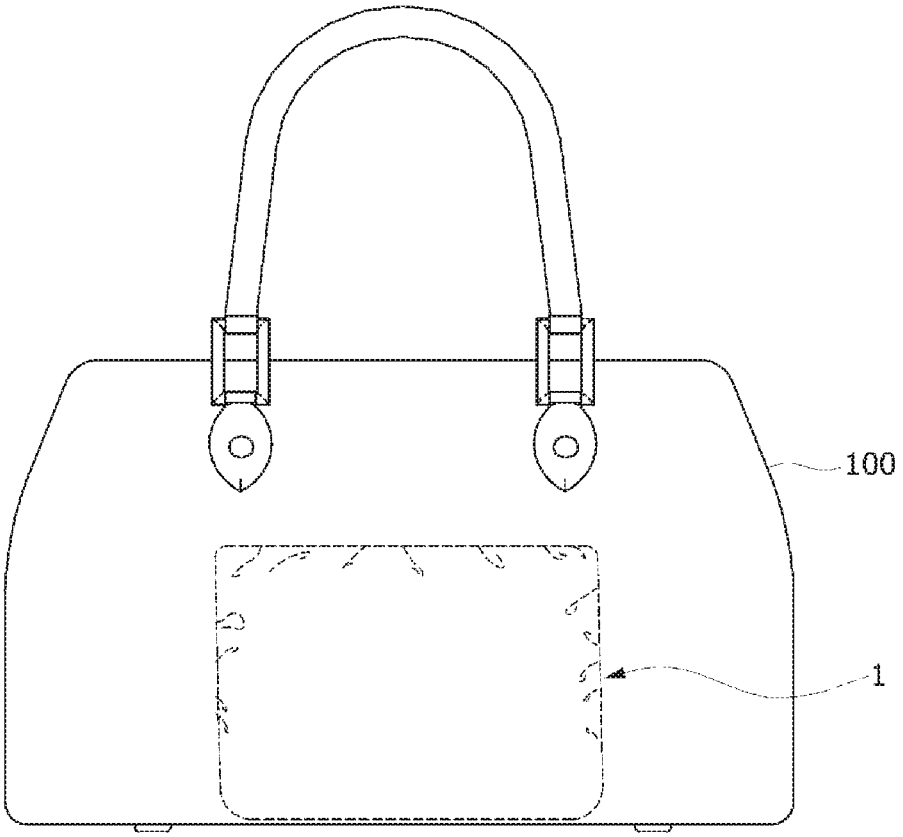
FIG. 2 is a view schematically illustrating a state in which the versatile bag of FIG. 1 is stored in another bag and used as an inner bag.

FIG. 2 is a view schematically illustrating a state in which the versatile bag of FIG. 1 is stored in another bag and used as an inner bag. Referring to FIGS. 1 and 2, the versatile bag 1 may be inserted in a tote bag 100 larger than the versatile bag 1. That is, a user may store personal effects in the versatile bag 1 and may carry the tote bag 100 in which the versatile bag 1 is stored. Particularly, since women may selectively store the versatile bag 1 in various types of tote bag 100 according to the nature of a meeting or their outfit, it is possible to easily and conveniently make a variety of fashionable looks.

For reference, the versatile bag 1 being used as an inner bag may mean the versatile bag 1 being inserted into a larger bag such as the tote bag 100. Also, the versatile bag 1 being used as an outer bag may mean the versatile bag 1 being carried alone and used.

Figure 3:
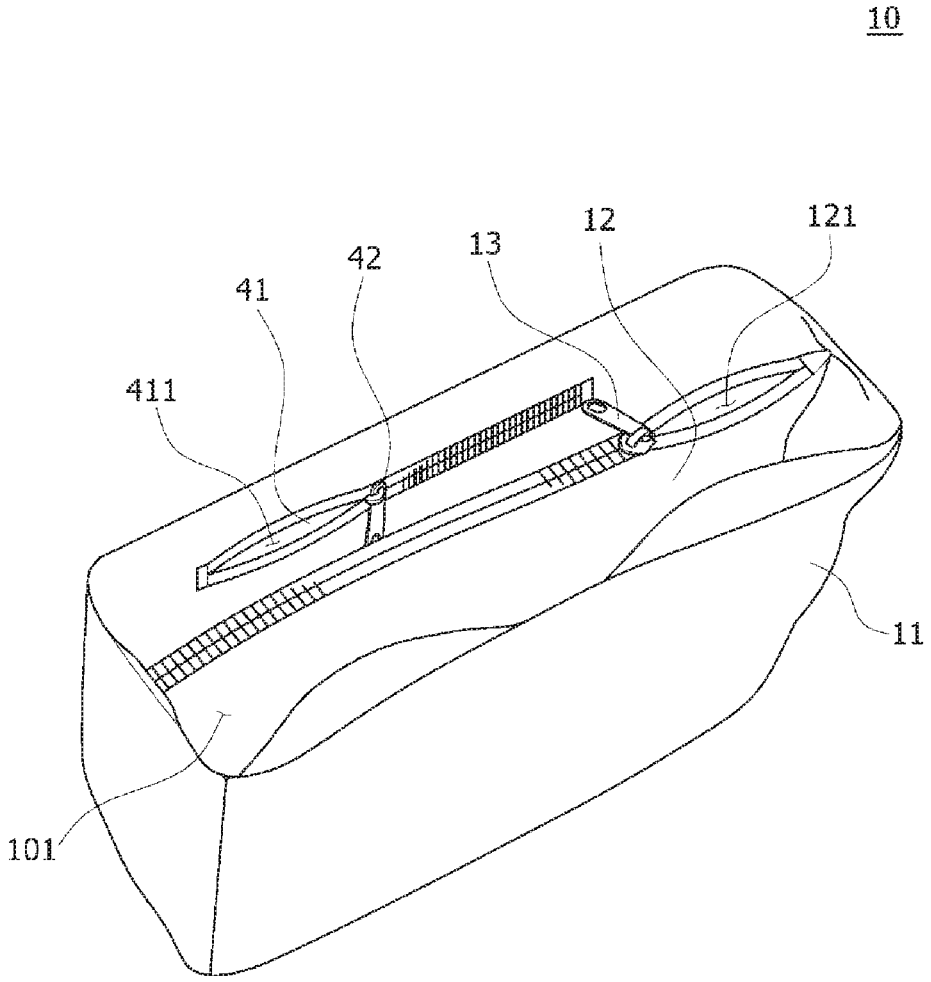
FIG. 3 is a view schematically illustrating a storage in the versatile bag according to one embodiment of the present invention.

FIG. 3 is a view schematically illustrating a storage in the versatile bag according to one embodiment of the present invention. Referring to FIGS. 1 and 3, the storage 10 according to one embodiment of the present invention includes a storage body 11, a storage divider 12, and a compartment opener 13.

The storage body 11 includes one side which is openable such that the main storage compartment 101 is formed. The deformable portion 20 is coupled to an outside of the storage body 11.

The storage divider 12 is coupled to an inside of the storage body 11 and divides the storage body 11. The storage divider 12 includes a divided storage compartment 121. For example, the storage divider 12 includes an open top, two sides, and a bottom, which are couplable with the storage body 11. Also, the main storage compartment 101 may be divided into two sections by one storage divider 12.

The compartment opener 13 is formed at the storage divider 12 and opens and closes the divided storage compartment 121. For example, the compartment opener 13 may be a zipper formed at an open portion of the storage divider 12.

The storage 10 according to one embodiment of the present invention may further include an auxiliary storage 41 and an auxiliary opener 42. The auxiliary storage 41 is formed inside the storage body 11 and includes an auxiliary storage compartment 411. The auxiliary opener 42 is formed at the auxiliary storage 41 and opens and closes the auxiliary storage compartment 411. For example, the auxiliary opener 42 may be a zipper formed at an open portion of the auxiliary storage 41.

Figure 4:
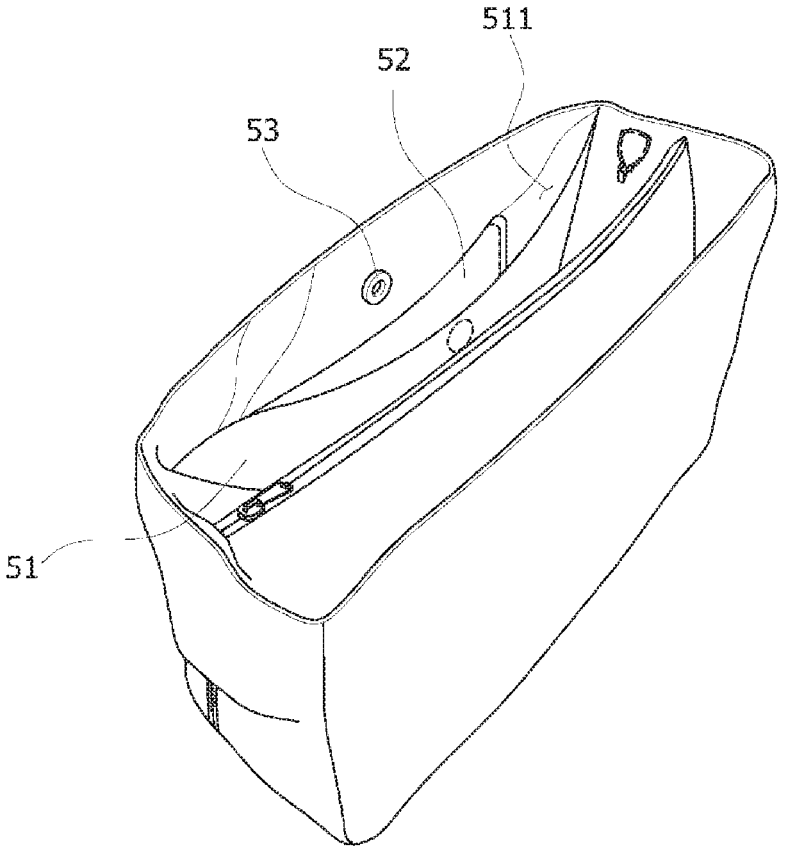
FIG. 4 is a view schematically illustrating a state in which a storage extender is inserted in a storage fastener in the storage of the versatile bag according to one embodiment of the present invention.
Figure 5:
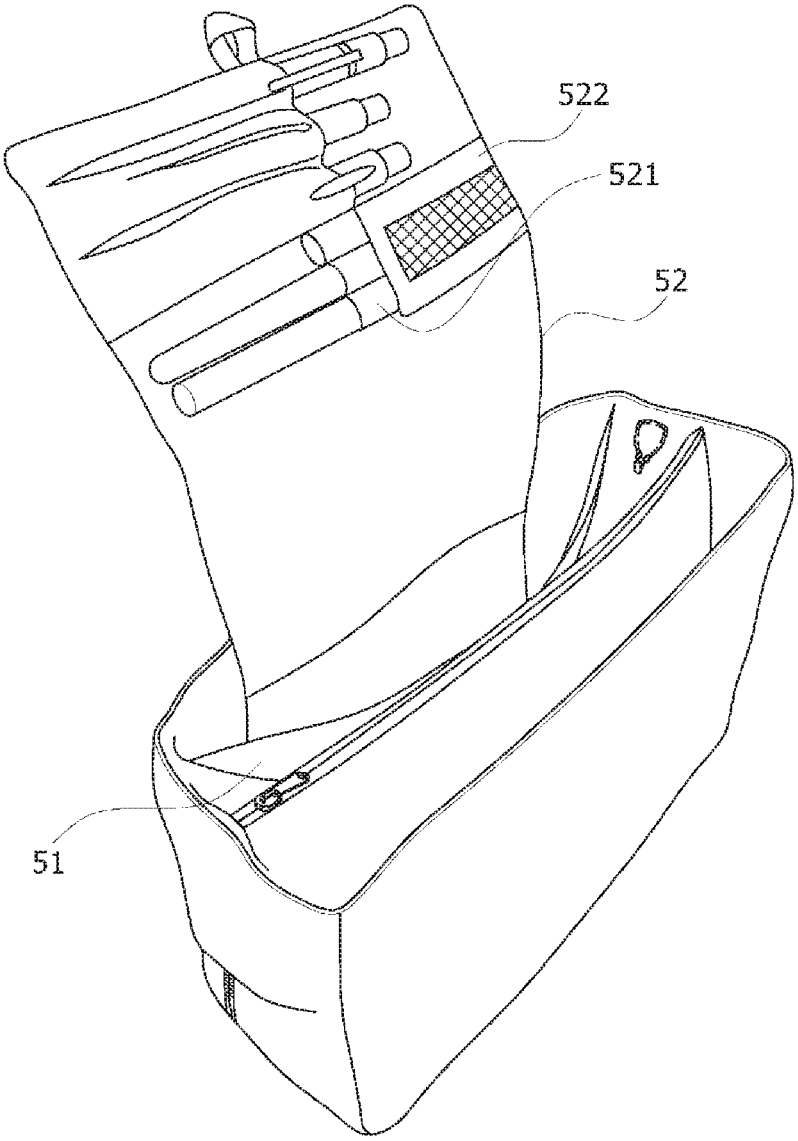
FIG. 5 is a view schematically illustrating a state in which the storage extender is withdrawn from the storage fastener of FIG. 4.

FIG. 4 is a view schematically illustrating a state in which a storage extender is inserted in a storage fastener in the storage of the versatile bag according to one embodiment of the present invention. FIG. 5 is a view schematically illustrating a state in which the storage extender is withdrawn from the storage fastener of FIG. 4. Referring to FIGS. 4 and 5, the storage 10 according to one embodiment of the present invention includes an additional storage 51, a storage extender 52, and a storage fastener 53.

The additional storage 51 is coupled to the inside of the storage body 11 and forms an additional storage compartment 511 between the additional storage 51 and the storage body 11. For example, other parts, except a top end of the additional storage 51, are coupled to the storage body 11 such that the additional storage compartment 511 may be formed between the additional storage 51 and the storage body 11.

The storage extender 52 is coupled to the storage body 11. The storage extender 52 is built in the additional storage compartment 511 or is withdrawn from the additional storage compartment 511. The storage extender 52 includes a plurality of storing portions 521 for storing items. For example, a length of the storage extender 52 may be greater than a height of the additional storage 51. Accordingly, when the storage extender 52 is folded or overlaps, the storage extender 52 may be embedded in the additional storage compartment 511. Also, when the storage extender 52 is unfolded, the storage extender 52 may be withdrawn from the additional storage compartment 511. Writing supplies such as a pencil and a ballpoint pen, stick-type cosmetic items, and the like may be mounted on the storing portions 521.

The storage fastener 53 attaches and detaches the additional storage 51 to or from the storage body 11. For example, the storage fastener 53 and the storage body 11 may be coupled by a magnet or by using a hook-coupling method. In addition, various coupling methods capable of preventing an unintended withdrawal of the storage extender 52 through attachment or detachment between the storage body 11 and the storage fastener 53 may be used.

The storage 10 according to one embodiment of the present invention may further include a cover protector 522. The cover protector 522 is formed at the storage extender 52 and protects the items. For example, the cover protector 522 may include one end coupled to the storage extender 52 and the other end attachable to and detachable from the storing portions 521. The cover protector 522 and the storing portions 521 may be coupled in various methods such as a Velcro-tape method, a snap fastener, and the like. The cover protector 522 may be mounted on the storing portions 521 and covers cosmetic items exposed outward to prevent the storage 10 from being stained with cosmetics.

Figure 6:
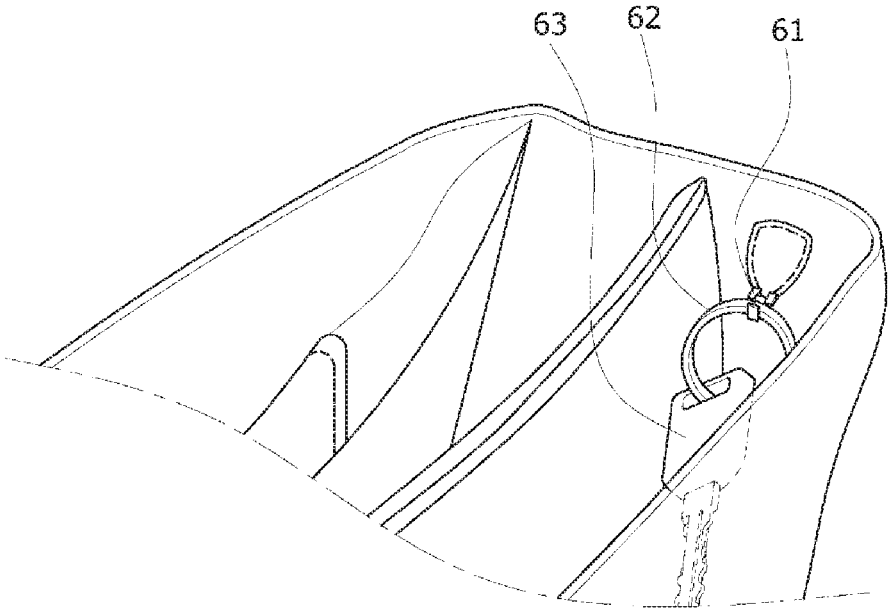
FIG. 6 is a view schematically illustrating a state in which a storage holder is formed in the storage of the versatile bag according to one embodiment of the present invention.

FIG. 6 is a view schematically illustrating a state in which a storage holder is formed in the storage of the versatile bag according to one embodiment of the present invention. Referring to FIGS. 1 and 6, the storage 10 according to one embodiment of the present invention may further include a storage holder 61.

The storage holder 61 is formed at the storage body 11, and a ring 62 is attached thereto and detached therefrom. For example, the storage holder 61 is fastened and opened through a spring type and the ring 62 formed at a car key 63 may be held by the storage holder 61 to be stored.

Figure 7:
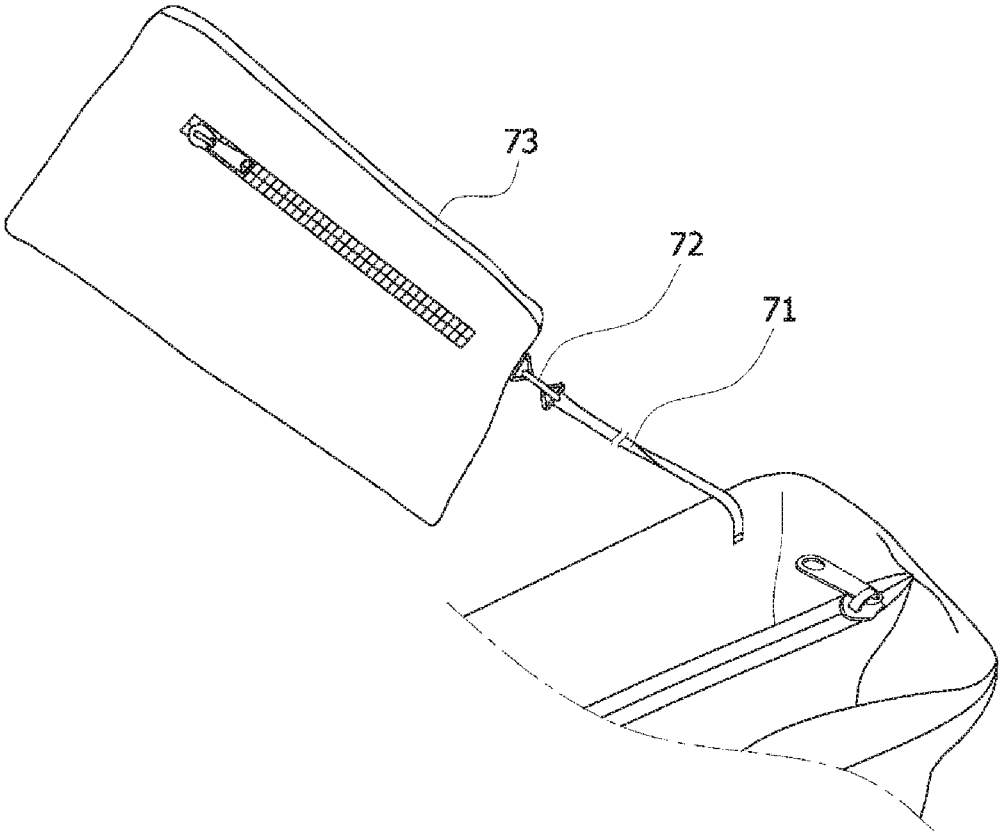
FIG. 7 is a view schematically illustrating a state in which a wallet is mounted in the storage of the versatile bag according to one embodiment of the present invention.

FIG. 7 is a view schematically illustrating a state in which a wallet is mounted in the storage of the versatile bag according to one embodiment of the present invention. Referring to FIGS. 1 and 7, the storage 10 according to one embodiment of the present invention may further include a storage string 71, a string holder 72, and a storage wallet 73.

The storage string 71 is formed at the storage body 11. For example, one end of the storage string 71 may be coupled to the inside of the storage body 11. The storage string 71 may have a considerable length to allow the storage wallet 73 to be easily used.

The string holder 72 is formed at the storage string 71. For example, the string holder 72 may be formed at the other end of the storage string 71. As the string holder 72, various components capable of being coupled to the storage wallet 73 or released from the storage wallet 73 through a simple operation may be used.

The storage wallet 73 is attached to and detached from the string holder 72. For example, the storage wallet 73 may include various storage spaces capable of storing cash or cards. Since the storage wallet 73 remains in a state of being connected to the storage string 71, it is possible to prevent only the storage wallet 73 from being stolen or lost. Since the storage wallet 73 is connected to the storage string 71, even when the storage wallet 73 is withdrawn from the storage 10 to be used, it is possible to maintain a state in which the storage wallet 73 is connected to the storage string 71.

FIGS. 8A-8E sequentially illustrate states in which the versatile bag according to one embodiment of the present invention is deformed from an inner bag into an outer bag. The deformable portion 20, which surrounds an outside of the storage 10, is deformed and covers an opened component of the storage 10 to autonomously form a bag shape.

Referring to FIGS. 1 and 8A-8E, the deformable portion 20 according to one embodiment of the present invention includes a deformable cover 21 and a deformable operator 22.

The deformable cover 21 is coupled to the outside of the storage 10 and partially incised. For example, the deformable cover 21 may be formed to surround an outer surface and a bottom of the storage body 11, and a part of the deformable cover 21, which covers both sides from below the storage body 11, may be incised. Due thereto, the deformable cover 21 may cover a bottom surface of the storage body 11 or a top of the storage body 11.

The deformable operator 22 is formed at the deformable cover 21 and attaches and detaches the partially incised deformable cover 21. For example, the deformable operator 22 may be a zipper which opens and closes the incised deformable cover 21. The deformable operator 22 may be two-way operable. That is, the deformable operator 22 is operable even when the deformable cover 21 covers not only the bottom surface of the storage body 11 but also the top of the storage body 11.

The deformable portion 20 according to one embodiment of the present invention may further include a deformation identifier 23. The deformation identifier 23 may be formed at the deformable cover 21 and may show a color of the versatile bag 1 which will be used as an outer bag.

For example, the deformation identifier 23 may be formed at the deformable cover 21. In an inner-bag state such as that depicted in FIG. 8A, an outer cover of the deformable cover 21 which covers the bottom of the storage body 11 may be exposed. In an outer-bag state such as that depicted in FIG. 8E, an inner cover of the deformable cover 21 which is turned inside out to cover the top of the storage body 11 may be exposed. Here, when a color of the inner cover of the deformable cover 21 is displayed at the deformation identifier 23, a user may know a color of the outer-bag state by viewing just the inner bag state of even a plurality of versatile bags 1.

Figure 8A:
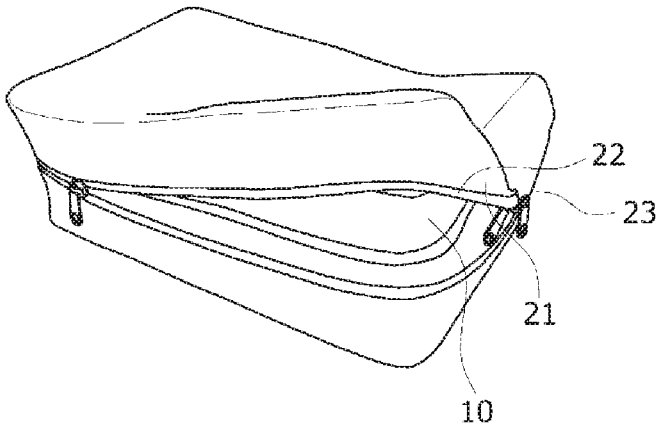
FIG. 8A is a view illustrating a state in which the versatile bag according to one embodiment of the present invention is in the process of being deformed from an inner bag into an outer bag.
Figure 8B:
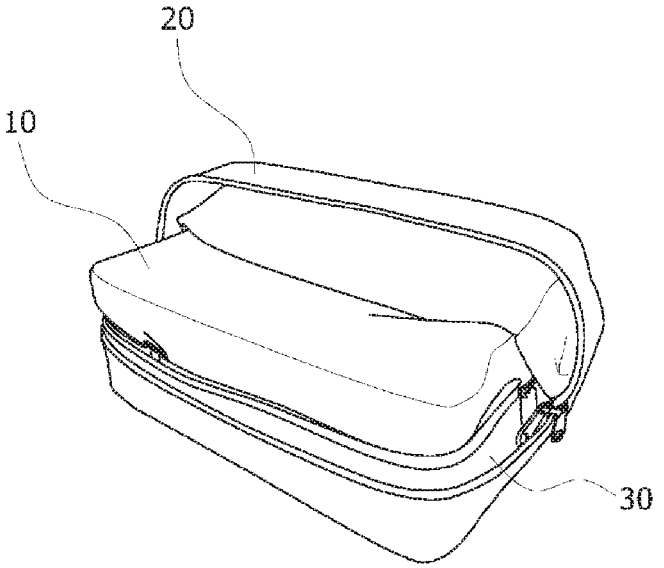
FIG. 8B is a view illustrating a state in which the versatile bag according to the embodiment shown in FIG. 8A has been further deformed in the process of being deformed from an inner bag into an outer bag.
Figure 8C:
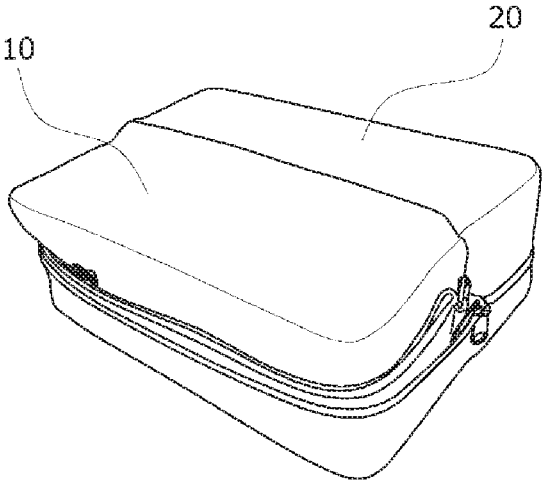
FIG. 8C is a view illustrating a state in which the versatile bag according to the embodiment shown in FIGS. 8A and 8B has been further deformed in the process of being deformed from an inner bag into an outer bag.
Figure 8D:
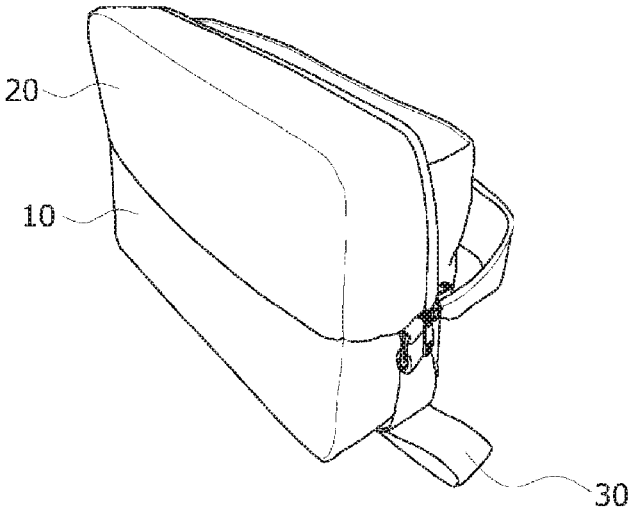
FIG. 8D is a view illustrating a state in which the versatile bag according to the embodiment shown in FIGS. 8A, 8B, and 8C has been further deformed in the process of being deformed from an inner bag into an outer bag.
Figure 8E:
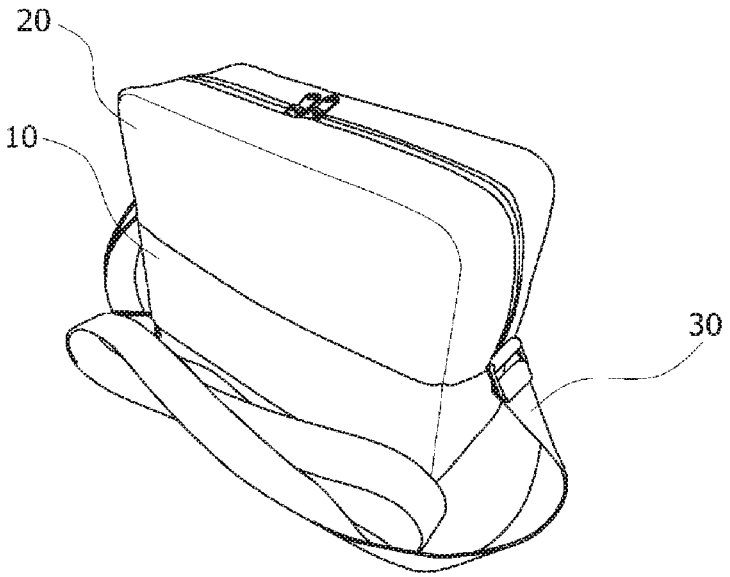
FIG. 8E is a view illustrating a state in which the versatile bag according to the embodiment shown in FIGS. 8A, 8B, 8C, and 8D has been deformed from an inner bag into an outer bag.

Referring to FIGS. 8D and 8E, the versatile bag 1 according to one embodiment of the present invention may further include a portability portion 30. The portability portion 30 may be coupled to the storage 10, be covered by the deformable portion 20, and may allow portability of the storage 10. For example, referring to FIGS. 3, 8D, and 8E, both ends of the portability portion 30 may be coupled to the storage body 11 and may be exposed outward when the deformable portion 20 covers the storage 10 and the versatile bag 1 is used an outer bag. In addition, the portability portion 30 may be formed at the deformable portion 20 to allow portability of the storage 10. For example, both ends of the portability portion 30 may be coupled to the deformable portion 20 and may be exposed outward when the deformable portion 20 covers the storage 10 and the versatile bag 1 is used an outer bag.

Figure 9:
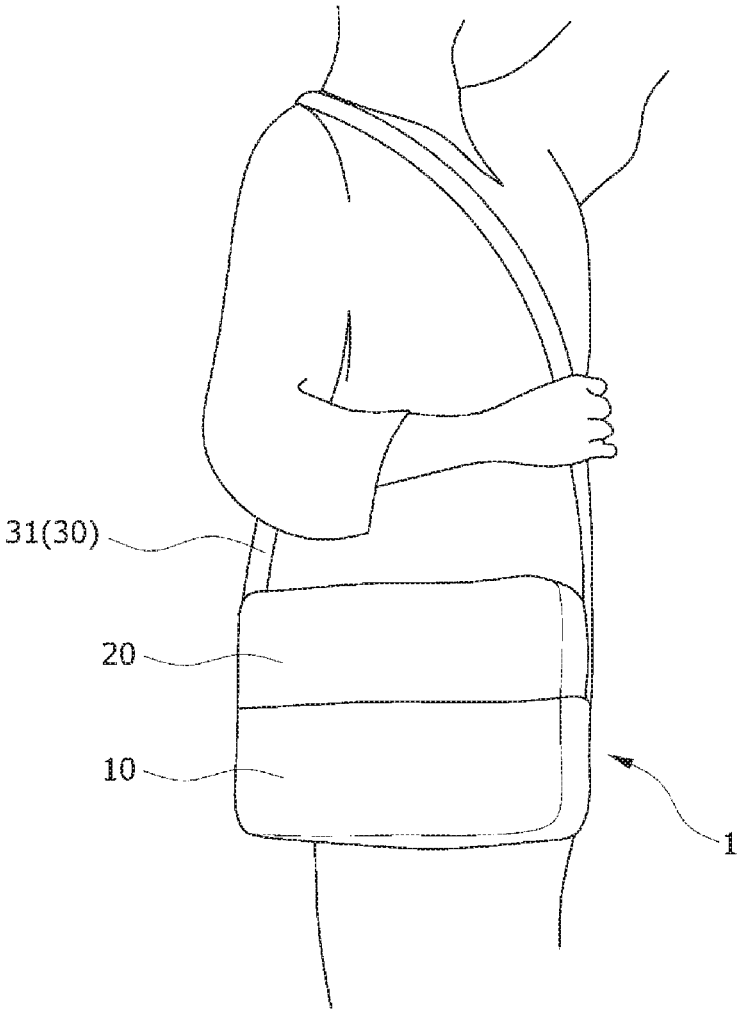
FIG. 9 is a view schematically illustrating a state in which the versatile bag according to one embodiment of the present invention is carried on a user's shoulder.
Figure 10:
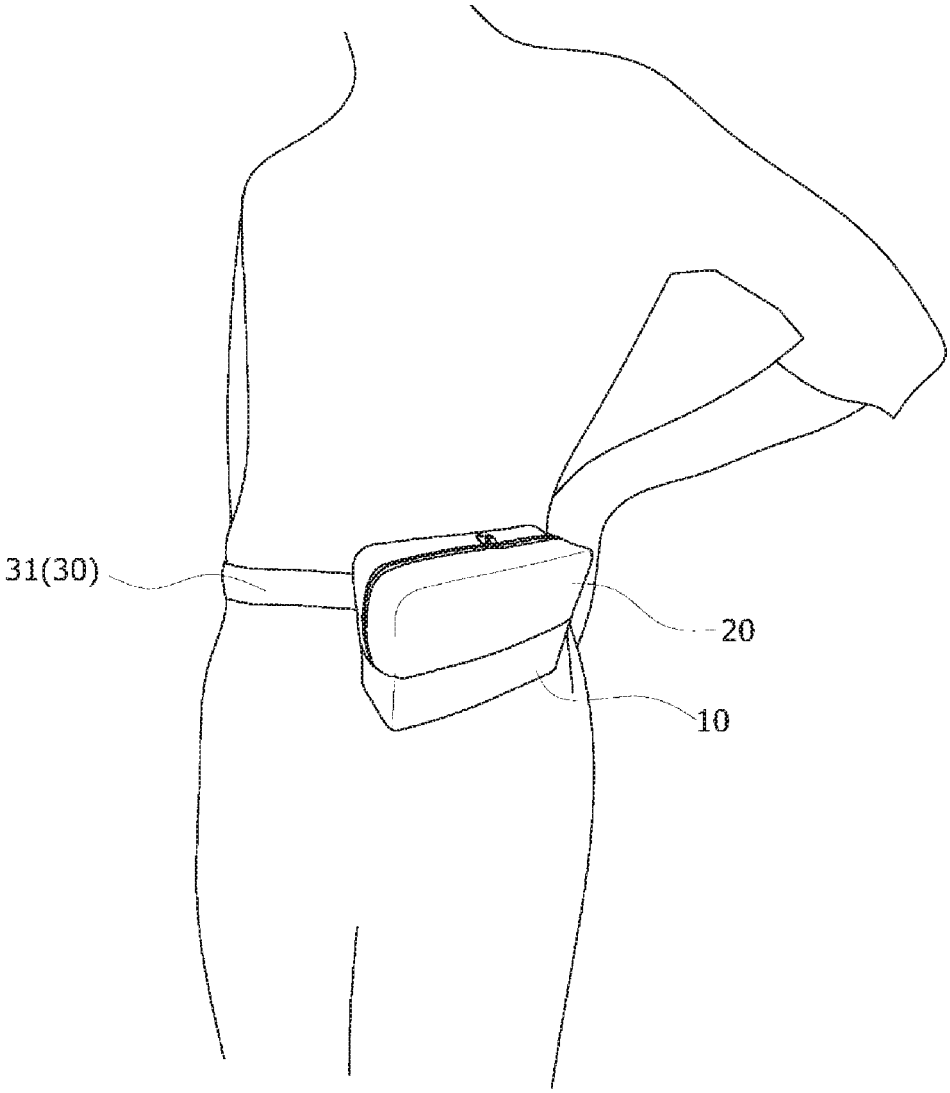
FIG. 10 is a view schematically illustrating a state in which the versatile bag according to one embodiment of the present invention is worn at a user's waist.

FIG. 9 is a view schematically illustrating a state in which the versatile bag according to one embodiment of the present invention is carried on a user's shoulder. FIG. 10 is a view schematically illustrating a state in which the versatile bag according to one embodiment of the present invention is worn at a user'ss waist. Referring to FIGS. 9 and 10, the portability portion 30 according to one embodiment of the present invention may be a strap 31.

The strap 31 may be formed to be coupled to the storage 10 or the deformable portion 20 and adjustable in length to be worn on a human body. That is, the strap 31 may be carried on a user's shoulder (refer to FIG. 9) or may be worn at a user's waist (refer to FIG. 10).

Figure 11:
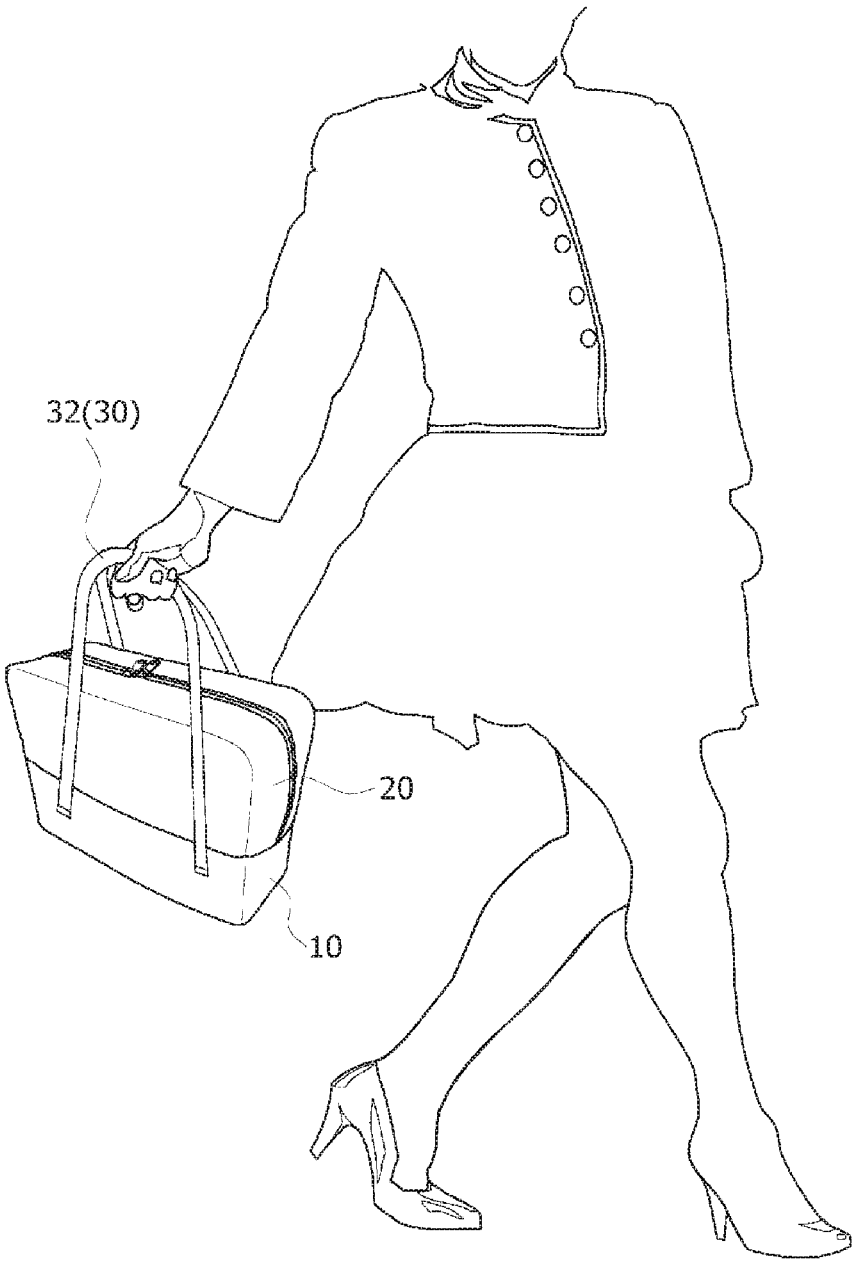
FIG. 11 is a view schematically illustrating a state of gripping a portability portion mounted in the storage of the versatile bag according to one embodiment of the present invention.

FIG. 11 is a view schematically illustrating a state of gripping the portability portion mounted in the storage portion of the versatile bag according to one embodiment of the present invention. Referring to FIG. 11, the portability portion 30 according to one embodiment of the present invention may be handles 32. A pair of such handles 32 may be coupled to the storage 10 and may have a grippable shape.

Figure 12:
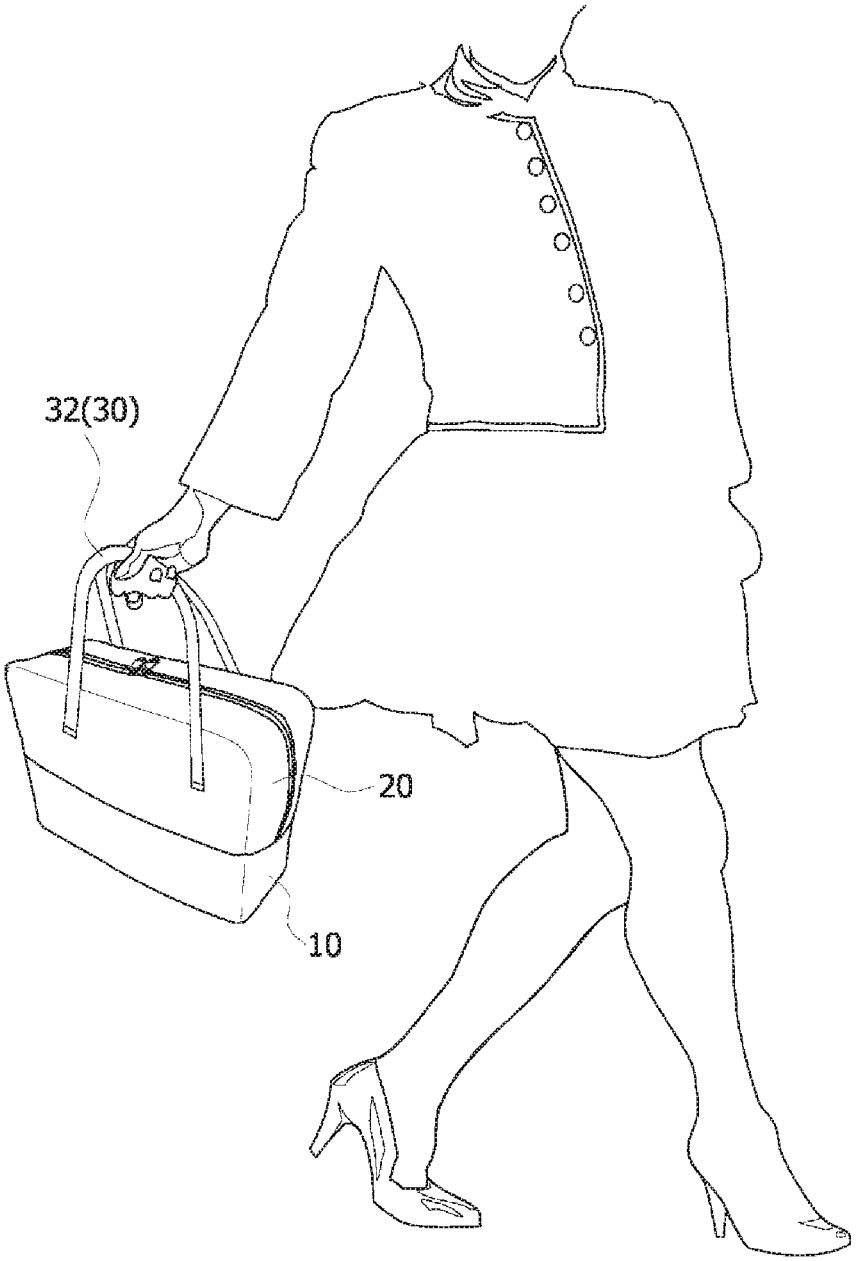
FIG. 12 is a view schematically illustrating a state of gripping the portability portion mounted in a deformable portion of the versatile bag according to one embodiment of the present invention.

FIG. 12 is a view schematically illustrating a state of gripping the portability portion mounted in the deformable portion of the versatile bag according to one embodiment of the present invention. Referring to FIG. 12, the portability portion 30 according to one embodiment of the present invention may be handles 32. A pair of such handles 32 may be coupled to the deformable portion 20 and may have a grippable shape.

Figure 13:
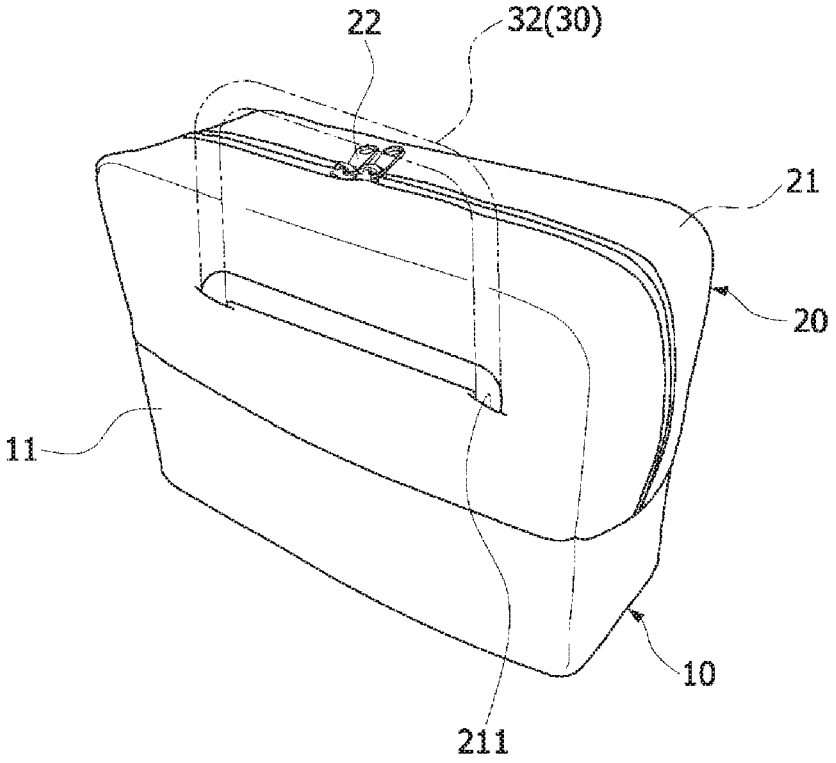
FIG. 13 is a view schematically illustrating a state in which handles are inserted in the deformable portion of the versatile bag according to one embodiment of the present invention.

FIG. 13 is a view schematically illustrating a state in which the handles are inserted in the deformable portion of the versatile bag according to one embodiment of the present invention. Referring to FIG. 13, the handles 32 according to one embodiment of the present invention may be coupled to an inside of the deformable portion 20 and may be inserted into the deformable portion 20. For example, the inner cover and the outer cover of the deformable cover 21 may be coupled to each other and the outer cover of the deformable cover 21 may be exposed outward to cover the storage 10 such that the versatile bag 1 may be used as an outer bag. The handles 32 may be inserted into the deformable cover 21 through insertion holes 211 formed at the outer cover of the deformable cover 21 to be coupled to the inner cover or an inner surface of the outer cover of the deformable cover 21. Due thereto, the handles 32 may be withdrawn from spaces formed between the inner cover and the outer cover of the deformable cover 21 to be gripped or may be inserted into the spaces formed between the inner cover and the outer cover of the deformable cover 21.

A method of using the versatile bag having the above-described structure according to one embodiment will be described as follows.

Various personal effects may be stored in the storage 10 of the versatile bag 1. That is, the storage body 11 includes the main storage compartment 101 and the main storage compartment 101 may be divided by the storage divider 12 to be used. Also, personal effects may be stored in the divided storage compartment 121 formed at the storage divider 12.

The auxiliary storage 41 may be formed inside the storage body 11 such that a user may store personal effects in the auxiliary storage compartment 411 formed at the auxiliary storage 41.

The additional storage 51 may be formed inside the storage body 11 such that a user may store personal effects in the additional storage compartment 511 formed at the additional storage 51. The storage extender 52 is built in the additional storage compartment 511, and writing supplies, cosmetic items, and the like may be mounted on the storage extender 52. Since the storage extender 52 is selectively withdrawn from the additional storage compartment 511, the user may use the writing supplies, cosmetic items, and the like by checking the storage extender 52 exposed outward. Here, the writing supplies, cosmetic items, and the like may be mounted on the storing portions 521 formed at the storage extender 52, and the cover protector 522 formed at the storage extender 52 may cover the cosmetic items to prevent other parts of the storage 10 from being contaminated with cosmetics.

In addition, the storage holder 61 for storing the car key 63 may be formed inside the storage body 11. Also, since the storage string 71 formed at the storage body 11 has a considerable length, the storage wallet 73 connected to the storage string 71 using the string holder 72 therebetween may be withdrawn from the main storage compartment 101 to be used. Here, the storage wallet 73 may remain in a state in which the storage string 71 and the storage wallet 73 are connected to each other and be prevented from being stolen or lost.

The user may use the versatile bag 1 as an inner bag with the storage 10 being exposed. That is, the user may store the versatile bag 1 with the storage 10 being exposed in the desired tote bag 100 and may carry the tote bag 100 in which the versatile bag 1 is stored (refer to FIG. 2). Due thereto, since the user may move the whole versatile bag 1 which stores personal effects even when the user uses various types of tote bag 100, an inconvenience of moving personal effects one by one as necessary may be avoided.

In addition, the user may use the versatile bag 1 as an outer bag with the storage 10 being covered and may directly carry the versatile bag 1 (refer to FIGS. 9 to 11). A process of changing an inner-bag state of the versatile bag 1 into an outer-bag state thereof will be described as follows. In the inner-bag state, the bottom of the storage 10 is covered by the deformable portion 20 and the user releases a coupled state of the deformable cover 21 by operating the deformable operator 22. Afterward, the partially incised deformable cover 21 is turned inside out to cover the top of the storage 10. When the deformable cover 21 covers the top of the storage 10, the deformable cover 21 is coupled by operating the deformable operator 22 (refer to FIGS. 8A-8E).

The versatile bag 1 according to one embodiment of the present invention may be used as an inner bag or an outer bag depending on a change in shape thereof.

In the versatile bag 1 according to one embodiment of the present invention, the storage divider 12 formed at the storage body 11 may divide the main storage compartment 101.

In the versatile bag 1 according to one embodiment of the present invention, personal effects may be stored through the auxiliary storage compartment 411 formed at the auxiliary storage 41.

In the versatile bag 1 according to one embodiment of the present invention, since the storage extender 52 stored in the additional storage 51 is withdrawn from the storage 10 to be used as necessary, writing supplies or cosmetic items may be exposed outward and conveniently used.

The versatile bag 1 according to one embodiment of the present invention may easily store the car key 63. Also, since the storage wallet 73 is connected to the storage string 71, the storage wallet 73 may be withdrawn from the storage 10 and used according to a length of the storage string 71 and may be prevented from being lost or stolen.

The versatile bag 1 according to one embodiment of the present invention may allow the storage 10 to be carried using the portability portion 30.

Although the invention has been illustrated and described in greater detail with reference to the preferred exemplary embodiment, the invention is not limited to the examples disclosed, and further variations can be inferred by a person skilled in the art, without departing from the scope of protection of the invention.

For the sake of clarity, it is to be understood that the use of "a" or "an" throughout this application does not exclude a plurality, and "comprising" does not exclude other steps or elements.

The invention claimed is:

1. A versatile bag comprising:

a storage comprising a main storage compartment which has one side open and stores personal effects; and a deformable portion which has a deformable shape to cover the main storage compartment or an outside of the storage;

wherein the deformable portion comprises:

a deformable cover coupled to the outside of the storage and partially incised; and a deformable operator which is formed at the deformable cover, attaches and detaches the partially incised deformable cover, and is a zipper capable of two-way operation, wherein the deformable cover covers a bottom surface of the storage so that the versatile bag is an inner bag, wherein the deformable cover is turned inside out while covering the bottom surface of the storage to cover the top of the storage, and the deformable operator is coupled with the partially incised deformable cover so that the versatile bag is an outer bag;

wherein the versatile bag further comprises a portability portion coupled to any one of the storage and the deformable portion to allow portability of the storage, wherein the portability portion is a strap which is coupled to any one of the storage and the deformable portion, is adjustable in length, and is configured to be worn on a human body.

2. The versatile bag of claim 1, wherein the storage comprises:

a storage body with an outside to which the deformable portion is coupled;

a storage divider which is coupled to an inside of the storage body to divide the storage body and comprises a divided storage compartment; and a compartment opener which is formed at the storage divider and opens and closes the divided storage compartment.

3. The versatile bag of claim 2, wherein the storage further comprises:

an auxiliary storage which is formed inside the storage body and comprises an auxiliary storage compartment; and an auxiliary opener which is formed at the auxiliary storage and opens and closes the auxiliary storage compartment.

4. The versatile bag of claim 2, wherein the storage further comprises:

an additional storage which is coupled to the inside of the storage body and forms an additional storage compartment between the additional storage and the storage body;

a storage extender which is coupled to the storage body to be built into the additional storage compartment or withdrawn from the additional storage compartment and comprises a plurality of storing portions to store items; and a storage fastener which attaches and detaches the additional storage to or from the storage body.

5. The versatile bag of claim 4, wherein the storage further comprises a cover protector which is formed at the storage extender and protects the items.

6. The versatile bag of claim 2, wherein the storage further comprises a storage holder which is formed at the storage body where a ring is attached and detached.

7. The versatile bag of claim 2, wherein the storage further comprises:

a storage string formed at the storage body;

a string holder formed at the storage string; and a storage wallet attachable to and detachable from the string holder.

8. The versatile bag of claim 1, wherein the deformable portion further comprises a deformation identifier which is formed at the deformable cover and shows a color.

* * * * *